US007679026B1

(12) United States Patent
Gefter et al.

(10) Patent No.: US 7,679,026 B1
(45) Date of Patent: Mar. 16, 2010

(54) MULTI-FREQUENCY STATIC NEUTRALIZATION OF MOVING CHARGED OBJECTS

(75) Inventors: Peter Gefter, South San Francisco, CA (US); Scott Gehlke, Berkeley, CA (US)

(73) Assignee: MKS Instruments, Inc., Andover, MA (US)

( * ) Notice: Subject to any disclaimer, the term of this patent is extended or adjusted under 35 U.S.C. 154(b) by 231 days.

(21) Appl. No.: 11/623,316

(22) Filed: Jan. 15, 2007

Related U.S. Application Data

(63) Continuation-in-part of application No. 11/398,446, filed on Apr. 5, 2006, which is a continuation-in-part of application No. 11/136,754, filed on May 25, 2005, which is a continuation-in-part of application No. 10/821,773, filed on Apr. 8, 2004, now Pat. No. 7,057,130.

(51) Int. Cl.
*B23K 10/00* (2006.01)

(52) U.S. Cl. ..... 219/121.52; 219/121.36; 219/121.57; 361/232; 250/288

(58) Field of Classification Search ..... 219/121.54, 219/121.57, 121.48, 121.43, 121.36, 121.52, 219/121.59; 361/250, 231; 250/423 F, 288
See application file for complete search history.

(56) References Cited

U.S. PATENT DOCUMENTS

| | | | |
|---|---|---|---|
| 5,095,400 | A | 3/1992 | Saito |
| 5,550,703 | A | 8/1996 | Beyer et al. |
| 5,630,949 | A | 5/1997 | Lakin |
| 5,847,917 | A | 12/1998 | Suzuki |
| 6,330,146 | B1 | 12/2001 | Blitshteyn et al. |
| 6,504,700 | B1 | 1/2003 | Hahne et al. |
| 6,636,411 | B1 | 10/2003 | Noll |
| 6,653,638 | B2 | 11/2003 | Fujii |
| 6,693,788 | B1 | 2/2004 | Partridge |
| 6,807,044 | B1 | 10/2004 | Vernitsky et al. |
| 6,826,030 | B2 | 11/2004 | Gorczyca et al. |
| 2002/0125423 | A1 | 9/2002 | Ebeling et al. |
| 2003/0007307 | A1 | 1/2003 | Lee et al. |
| 2003/0011957 | A1 | 1/2003 | Nilsson |

(Continued)

FOREIGN PATENT DOCUMENTS

| | | |
|---|---|---|
| EP | 1142455 | 11/2002 |

(Continued)

OTHER PUBLICATIONS

Written Opinion Of The International Searching Authority, Jul. 28, 2005, PCT/US05/09093.

(Continued)

*Primary Examiner*—Mark H Paschall
(74) *Attorney, Agent, or Firm*—Stephen R. Uriarte

(57) ABSTRACT

Efficient static neutralization of an electrostatically charged object that has a varying distance from an ion generating source, a varying velocity, a large dimension or any these is achieved by using an ionizing cell or bar having a first electrode and a second electrode. The first electrode for receiving a multi-frequency voltage that has a waveform, and the second electrode separated from the first electrode by a first distance and for use as a reference electrode. The waveform is adjusted during neutralization of a moving object based on at least one attribute of the object.

20 Claims, 9 Drawing Sheets

U.S. PATENT DOCUMENTS

| | | | |
|---|---|---|---|
| 2004/0130271 | A1 | 7/2004 | Sekoguchi et al. |
| 2005/0052815 | A1 | 3/2005 | Fujiwara et al. |

FOREIGN PATENT DOCUMENTS

| | | | |
|---|---|---|---|
| JP | 5047490 | | 2/1993 |
| JP | 05047490 | A | 2/1993 |
| JP | 7249497 | | 9/1995 |
| JP | 07249497 | A | 9/1995 |
| JP | 10055896 | | 2/1998 |
| JP | 10055896 | A | 2/1998 |
| JP | 11273893 | | 9/1999 |
| JP | 11273893 | A | 10/1999 |
| JP | 10268895 | | 2/2000 |
| JP | 2000058290 | | 2/2000 |
| JP | 2000058290 | A | 2/2000 |
| JP | 2002216994 | A | 8/2002 |
| JP | 2002216994 | | 9/2002 |
| WO | WO0038484 | | 6/2000 |

OTHER PUBLICATIONS

International Search Report and Written Opinion, PCT/US0509093, Jul. 28, 2005.

MULTI-FREQUENCY STATIC NEUTRALIZATION OF MOVING CHARGED OBJECTS

CROSS-REFERENCE TO RELATED APPLICATIONS

This application is a continuing-in-part application, which claims the benefit of U.S. patent application, entitled "Multi-Frequency Static Neutralization", having Ser. No. 11/398,446, filed on Apr. 5, 2006, which claims the benefit of U.S. patent application, entitled "Wide Range Static Neutralizer and Method," having Ser. No. 11/136,754 and filed on May 25, 2005, which in turn claims the benefit of U.S. Pat. No. 7,057,130, entitled "Ion Generation Method and Apparatus", filed on Apr. 8, 2004 and having Ser. No. 10/821,773.

FIELD OF THE INVENTION

The present invention relates to static neutralization of an electrostatically charged object, and more particularly, to efficient static neutralization of an electrostatically charged object that has a varying distance from an ion generating source, a varying velocity, or a large dimension or any combination of these.

BACKGROUND OF THE INVENTION

One current solution to improving static charge neutralization efficiency includes using forced gas. However, such an approach alone is sometimes not well suited for moving charged objects, charged objects that vary in distance from a source of neutralizing ions, charged objects that have a varying velocity, large objects or any combination of these. Consequently, a need for providing improved static charge neutralization efficiency for moving objects, large objects or both exists.

DETAILED DESCRIPTION OF THE INVENTION

While the invention has been described in conjunction with a specific best mode, it is to be understood that many alternatives, modifications and variations will be apparent to those skilled in the art having the benefit of this disclosure. The use of these alternatives, modifications and variations in or with the various embodiments of the invention shown below would not require undue experimentation or further invention.

The various embodiments described below, are generally directed to the electrostatic neutralization of an electrostatically charged object, named "charged object", by applying an alternating voltage having a complex waveform, hereinafter referred to as a "multi-frequency voltage", to an ionizing electrode in an ionizing cell. When the multi-frequency voltage, measured between the ionizing electrode and a reference electrode available from the ionizing cell, exceeds the corona onset voltage threshold of the ionizing cell, the multi-frequency voltage generates a mix of positively and negatively charged ions, sometimes collectively referred to as a "bipolar ion cloud". The multi-frequency voltage also redistributes these ions into separate regions according to their negative or positive ion potential when the multi-frequency voltage creates a polarizing field of sufficient strength. The redistribution, sometimes referred to as polarization herein, of these ions increases the effective range in which available ions may be displaced or directed towards a charged object.

The bipolar ion cloud has a weighted center that oscillates between the ionizing electrode and the reference electrode. When used with reference to a bipolar ion cloud, the term "weighted center" refers to a space of the ion cloud having the highest concentration of approximately equal number of positive and negative ions.

The term "ionizing electrode" includes any electrode that has a shape suitable for generating ions. Other shapes may be used when implementing ionizing electrode 6, such as an electrode having a sharp point or a small tip radius, a set of more than one sharp point, a wire, a loop-shaped wire or equivalent ionizing electrode.

The term "corona onset voltage threshold" is a voltage potential between an ionizing electrode and a reference electrode that when reached or exceeded creates ions by corona discharge. The corona onset voltage threshold is typically a function of the parameters of the ionization cell, such as the configuration of the ionizing electrode(s) and reference electrode(s) employed by the ionizing cell, the distance between these ionizing electrode(s) and reference electrode(s), the polarity of the ionizing voltage, and the physical environment in which the ionization cell is used. For a filament or wire type ionizing electrode, the corona onset voltage threshold is typically in the range of 4 kV and 6 kV for positive ionizing voltages and in the range of −3.5 kV and −5.5 kV for negative ionizing voltages.

Figure 1A:
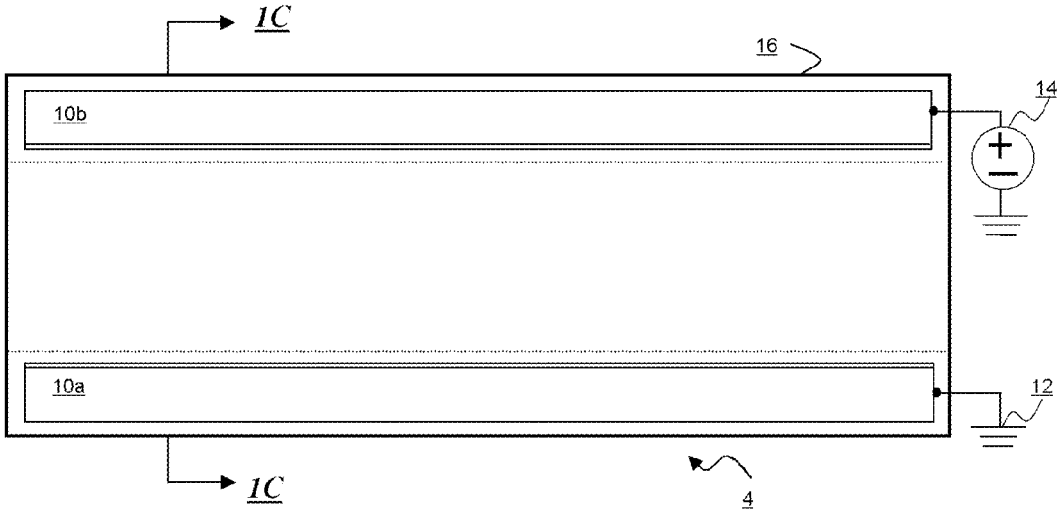
FIGS. 1A-1B are top and bottom views, respectively, in block illustration form of an ionizing cell in accordance with a first embodiment of the present invention.
Figure 1B:
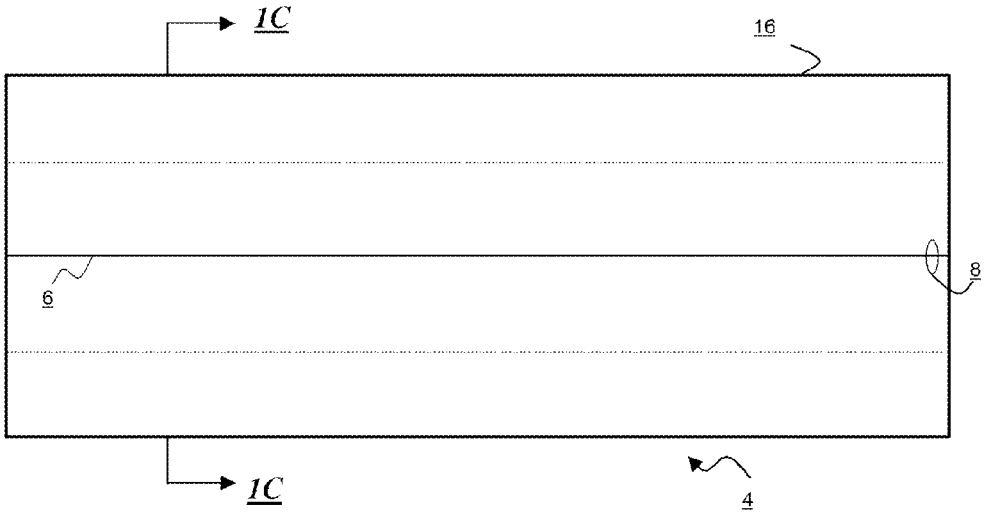
Figure 1C:
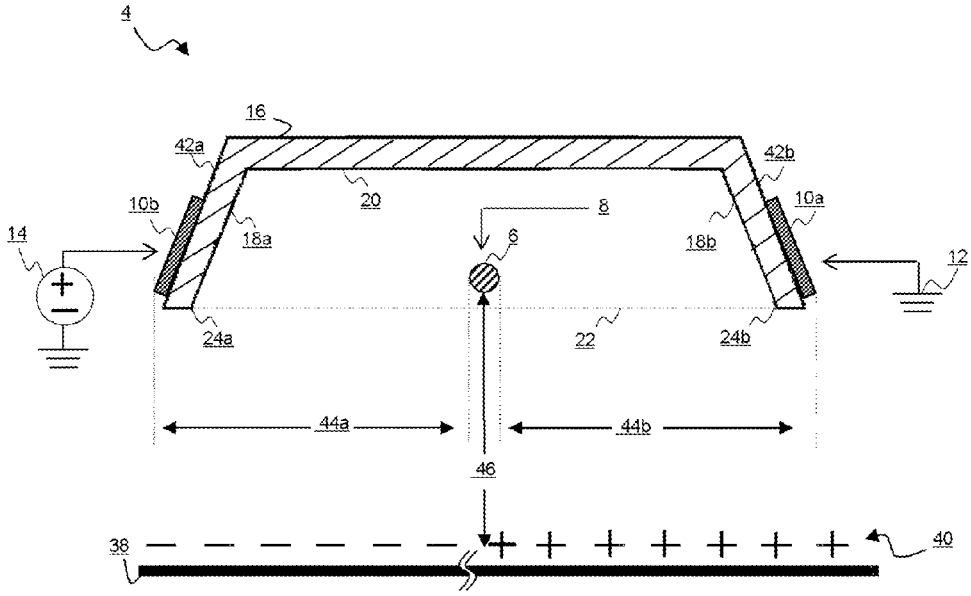
FIG. 1C is a sectional view along line 1C-1C of the ionizing cell illustrated in FIGS. 1A-1B.

Referring now to FIGS. 1A through 1C, an ionizing cell 4 is illustrated in accordance with a first embodiment of the present invention. Ionizing cell 4 includes an ionizing electrode 6 for receiving a multi-frequency voltage 8 and electrodes 10*a* and 10*b* for receiving respectively a reference voltage 12, such as ground, and an ion balancing voltage 14.

Electrodes 10*a* and 10*b* are hereafter named reference electrodes 10*a* and 10*b*, respectively. Ionizing cell 4 also includes a structure 16 that provides a mechanical and electrically insulating support for electrode 6 and reference electrodes 10*a* and 10*b*.

Using two reference electrodes is not intended to limit the present invention in any way. An ionizing cell may be limited to a single reference electrode for receiving a reference voltage 12. Reference voltage 12 may be fixed or dynamically adjusted according to the balance of positive ions and negative ions desired. For example, reference voltage 12 may be set to ground. In another example, reference voltage 12 may be adjusted dynamically using a current sensing circuit (not shown) that senses the ion current balance created during corona discharge and that adjusts ion balancing voltage 14 to maintain an approximate balance of positive and negative ions created. In both examples, using a separate ion balancing voltage and an additional reference electrode to receive the ion balancing voltage may be omitted, such as ion balancing voltage 14 and reference electrode 10*b*, respectively.

In another example, the reference electrode(s) used may be coupled to the common output, such as ground, of a power supply having a voltage output providing a multi-frequency voltage. This power supply is not shown in FIGS. 1A through 1C, and examples of such a power supply are disclosed in FIGS. 5 and 6, below.

Ionizing electrode 6 is located within structure 16 at a location within the space defined between inner side walls 18*a* and 18*b* and between inner top surface 20 and a plane 22 defined by edges 24*a* and 24*b* of inner side walls 18*a* and 18*b*, respectively. The location of ionizing electrode 6 within structure 16 is not intended to limit the various embodiments disclosed herein although one of ordinary skill in the art would readily recognize after receiving the benefit of the herein disclosure that locating ionizing electrode 6 within structure 16 enhances the harvesting of ions when using a driven gas, such as air, to assist with the dispersion of these ions.

Ionizing electrode 6 has a shape suitable for generating ions by corona discharge and, in the example shown in FIGS. 1A through 1C, is in the form of a filament or wire. Using a filament or wire to implement ionizing electrode 6 is not intended to limit the scope of various embodiments disclosed herein. Other shapes may be used when implementing ionizing electrode 6, such as an electrode having a sharp point or a small tip radius, a set of more than one sharp point, a loop-shaped wire or equivalent ionizing electrode.

Figure 2A:
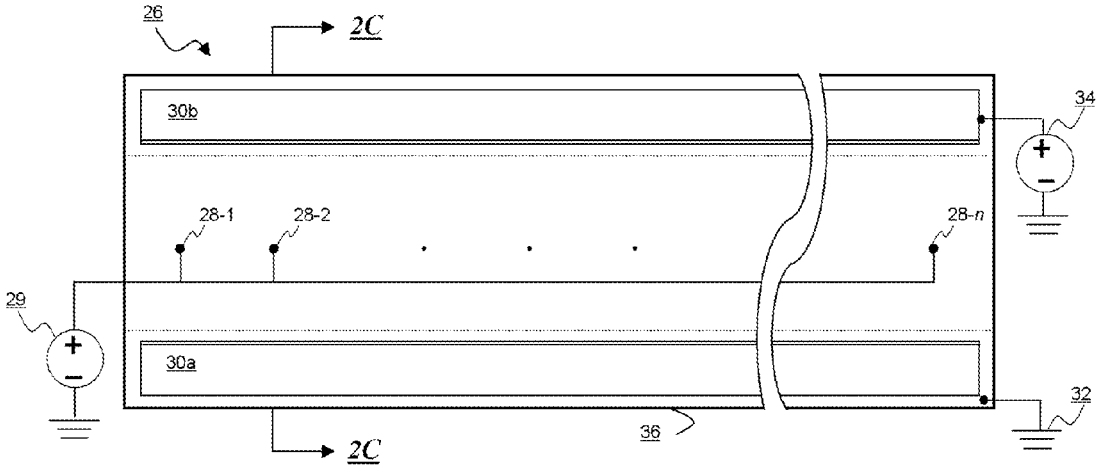
FIGS. 2A-2B are top and bottom views, respectively, in block illustration form of an ionizing cell in accordance with another embodiment of the present invention.
Figure 2B:
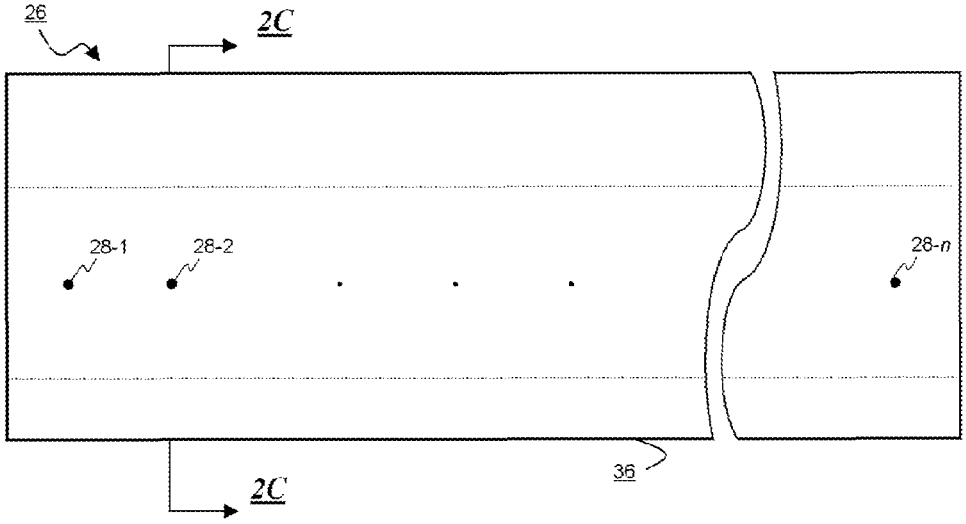
Figure 2C:
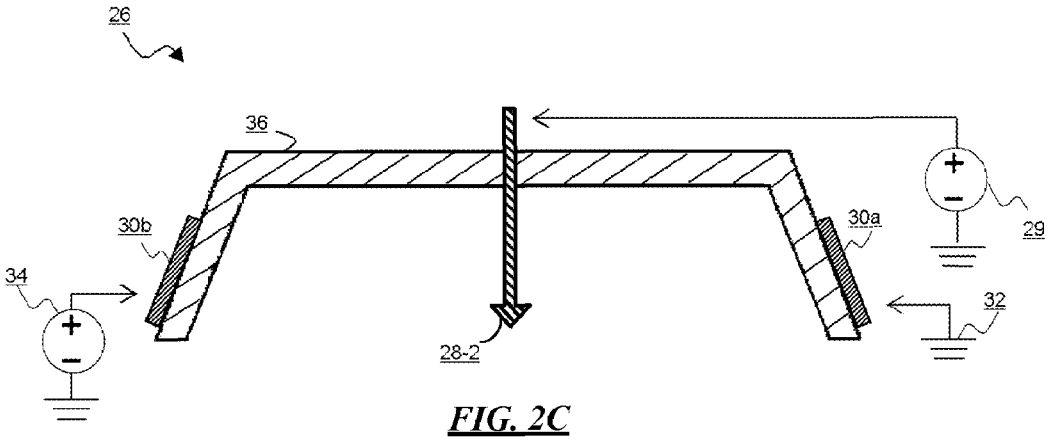
FIG. 2C is a sectional view along line 2C-2C of the ionizing cell illustrated in FIGS. 2A-2B.

For example, referring to FIGS. 2A through 2C, an ionizing cell 26 having a set of ionizing electrodes 28-1 through 28-*n*, that each have a sharp point, where n represents the maximum number of ionizing electrodes defined in the set, and that receive a multi-frequency voltage 29, may be employed in another embodiment of the present invention. Ionizing cell 26 also includes electrodes 30*a* and 30*b* for respectively receiving a reference voltage 32, such as ground, and an ion balancing voltage 34; and a structure 36 that provides a mechanical and electrically insulating support for ionizing electrodes 28-1 through 28-*n* and reference electrodes 30*a* and 30*b*. Ionizing cell 26, ionizing electrodes 28-1 through 28-*n*, multi-frequency voltage 29, electrodes 30*a* and 30*b*, reference voltage 32, ion balancing voltage 34 and structure 36 respectively have substantially the same function and if applicable, the same structure as ionizing cell 4, ionizing electrode 6, multi-frequency voltage 8, electrodes 10*a* and 10*b*, reference voltage 12, ion balancing voltage 34 and structure 16.

Referring again to FIGS. 1A through 1C, reference electrodes 10*a* and 10*b* each have a relatively flat surface and are located on surfaces of the structure 16 that face away from at least one of the ionizing electrodes, such as on surfaces 42*a* and 42*b*, respectively. Using a pair of reference electrodes or a relatively flat surface for reference electrodes 10*a* and 10*b* is not intended to limit the various embodiments disclosed. In addition, after receiving the benefit of this disclosure, it would be readily apparent that other shapes may also be used for reference electrodes 10*a* and 10*b*, including a shape having a cross-section similar to that of a circle or semi-circle (not shown).

A reference electrode may be placed at a distance from ionizing electrode 6 in the range of 5E-3 m to 5E-2 m. For example, since ionizing cell 4 utilizes a pair of reference electrodes 10*a* and 10*b*, which are respectively located at a distance 44*a* and a distance 44*b* in the range of 5E-3 m to 5E-2 m from ionizing electrode 6.

Electrodes 6, 10*a* and 10*b* may be placed at a location near an electro-statically charged object 38 having a surface charge 40 by using structure 16 to set object distance 46 in the range in which available neutralizing ions may be displaced or directed effectively towards surface charge 40. This effective range is currently contemplated to be from a few multiples of the distance between an ionizing electrode and a reference electrode, such as the dimensions defined by distances 44*a* or 44*b*, up to 100 inches although this range is not intended to be limiting in any way. Structure 16 is electrically non-conductive and insulating to an extent that its dielectric properties minimally affect the creation and displacement of ions as disclosed herein. The dielectric properties of structure 16 may be in the range of resistance of between 1E11 to 1E15Ω and have a dielectric constant of between 2 and 5. Object distance 46 is defined as the shortest distance between the closest edges of an ionizing electrode and of an object intended for static neutralization, such as ionizing electrode 6 and charged object 38, respectively.

Figure 3A:
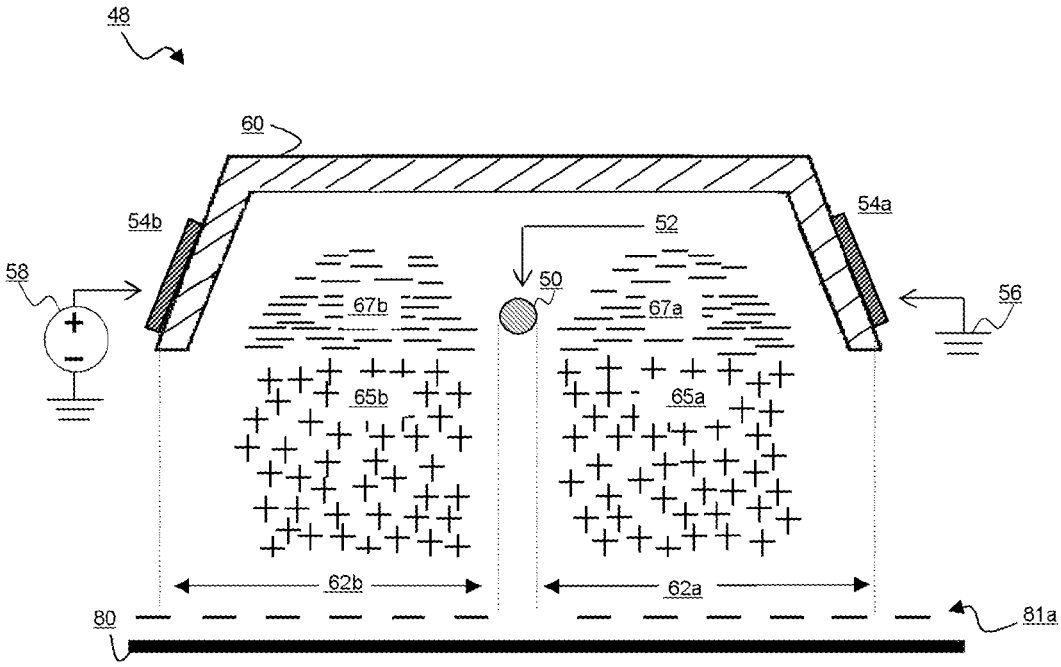
FIGS. 3A-3B illustrate the creation and polarization of ion clouds in accordance with yet another embodiment of the present invention.
Figure 3B:
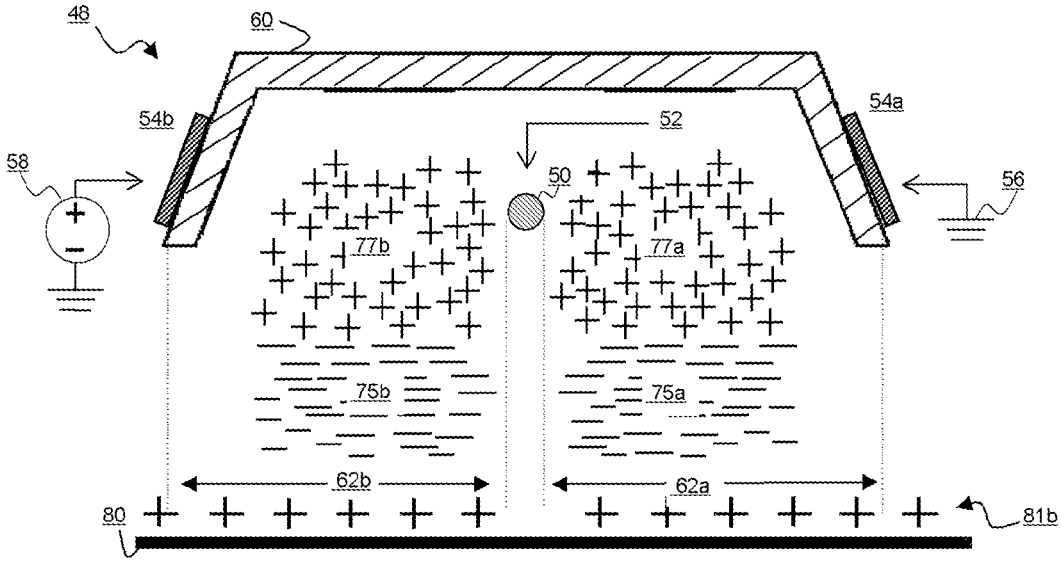
Figure 3C:
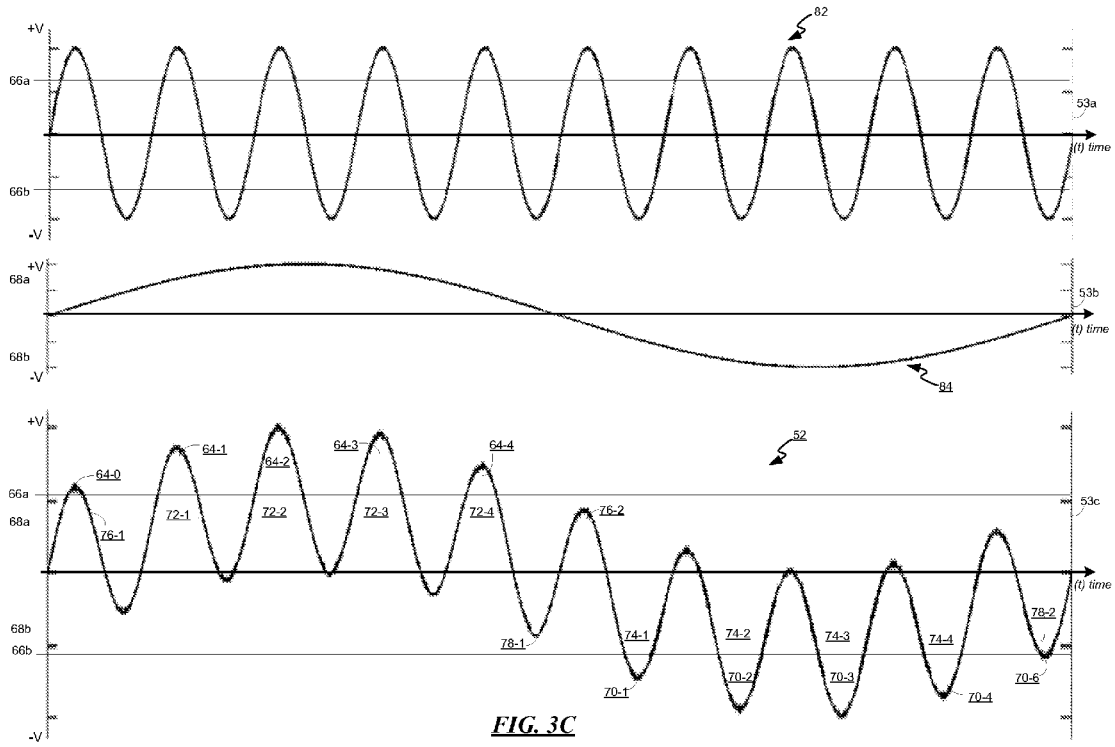
FIG. 3C illustrates a multi-frequency voltage formed by combining a first component voltage and a second component voltage in accordance with yet another embodiment of the present invention.

FIGS. 3A-3C illustrate the effect of using a multi-frequency voltage to create and to redistribute or polarize an alternating bipolar ion cloud over a given time period in accordance with another embodiment of the present invention. FIGS. 3A and 3B include sectional illustrations of an ionizing cell 48 having substantially the same elements and function as ionizing cell 4 described above and include an ionizing electrode 50 for receiving a multi-frequency voltage 52, reference electrodes 54*a* and 54*b* for receiving a reference voltage 56, such as ground, and an ion balancing voltage 58, respectively, and a structure 60. Ionizing cell 48, reference electrodes 54*a* and 54*b*, reference voltage 56, ion balancing voltage 58 and structure 60 have substantially the same function and if applicable, the same structure as ionizing cell 4, electrodes 10*a* and 10*b*, reference voltage 12, ion balancing voltage 34 and structure 16, respectively.

The two closest respective edges of ionizing electrode 50 and reference electrode 54*a* defines distance 62*a*, the two closest respective edges of ionizing electrode 50 and reference electrode 54*b* defines distance 62*b*. Distance 62*a* and distance 62*b* are substantially equal in the embodiment shown.

FIG. 3C includes time-voltage plots 53*a*, 53*b* and 53*c*. Plot 53*a* shows an example of a wave form of a high frequency voltage component 82. Plot 53*b* shows an example of wave form of a low frequency component 84, and plot 53*c* shows multi-frequency voltage 52, which is formed when high frequency voltage component 82 and low frequency voltage component 84 are combined.

Multi-frequency voltage 52 has a waveform that includes during at least one frequency period, a first time-voltage region, a second time-voltage region and a third time-voltage region. First time-voltage region describes a waveform area representing the voltage amplitude of multi-frequency voltage 52 for a given time period in which either positive or negative ions are created by corona discharge and are redistributed according to the polarity of the created ions and the polarity of multi-frequency voltage 52 while in the first time-voltage region.

For example, as shown in FIGS. 3A and 3C, when in any of first time-voltage regions 64-0 through 64-4, multi-frequency voltage 52 has a positive voltage exceeding a positive corona onset voltage threshold 66*a* and a positive polarization threshold voltage 68*a* for ionizing cell 48 during a given time period. Multi-frequency voltage 52 thus creates positive ions by corona discharge within distances 62*a* and 62*b*, as shown in FIG. 3A. Also, while in first time-voltage regions 64-0 through 64-4, multi-frequency voltage 52 redistributes ions because the positive polarizing field created by multi-frequency voltage 52 within distances 62*a* and 62*b* attracts negative ions 67*a* and 67*b* and repels positive ions 65*a* and 65*b*. First time-voltage regions in which a multi-frequency voltage 52 has a positive voltage, such as first time-voltage regions 64-0 through 64-4, may be hereinafter referred to as positive first time-voltage regions.

The term "polarizing field" is defined as an electrical field created between an ionizing electrode, such as ionizing electrode 50, and a reference electrode(s), such as reference electrode 54*a*, reference electrode 54*b* or both, that creates a sufficient polarizing field intensity to redistribute positive and negative ions, which are in the space between the ionizing electrode and the reference electrode(s), into separate regions according to the polarity of the ions. Redistributing ions increases the effective range in which available ions may be displaced or directed towards a charged object 80 without the use of a stream of gas or other means. Polarizing fields are not shown to avoid overcomplicating the herein disclosure. Charged object 80 is depicted in FIG. 3A to have a region having a negative charge 81*a*.

The term "polarization threshold voltage" is defined to mean voltage amplitude or potential between an ionizing electrode and a reference electrode that when exceeded creates a positive or negative electrical field of sufficient intensity to redistribute positive and negative ions available in the space between an ionizing electrode and a reference electrode.

As shown in FIGS. 3B and 3C, when in any of first time-voltage regions 70-1 through 70-6, multi-frequency voltage 52 has a negative voltage exceeding a negative corona onset voltage threshold 66*b* and a negative polarization threshold voltage 68*b* for ionizing cell 48 during a given time period. Multi-frequency voltage 52 thus creates a cloud of negative ions 71*a* and 71*b* by corona discharge within distances 62*a* and 62*b*, as shown in FIG. 3B. Also, while in first time-voltage region 70-1 through 70-6, multi-frequency voltage 52 redistributes ions because the negative polarizing field created by multi-frequency voltage 52 within distances 62*a* and 62*b* attracts positive ions 73*a* and 73*b* and repels negative ions 71*a* and 71*b*. First time-voltage regions in which a multi-frequency voltage 52 has a negative voltage, such as first time-voltage regions 70-1 through 70-4, may be hereinafter referred to as negative first time-voltage regions. Charged object 80 is depicted in FIG. 3B to have a region having a positive charge 81*b*.

Ions created by corona discharge do not dissipate immediately by recombination but have a certain lifetime, which is approximately within one to sixty (60) seconds in clean gas or air after the corona discharge ends. Negative ions, such as negative ions 67*a* and 67*b*, redistributed in a positive first time-voltage region, such as in first time-voltage region 64-0, 64-1, 64-2, 64-3 or 64-4, are negative ions previously created that have not yet recombined with positive ions or been neutralized by a charged object. Alternatively, positive ions, such as positive ions 73*a* and 73*b*, redistributed in a negative first time-voltage region, such as in first time-voltage region 70-1, 70-2, 70-3, 70-4 or 70-6, are positive ions previously created that have not yet recombined with positive ions or been neutralized by a charged object.

The second time-voltage region describes a waveform area representing the voltage amplitude of multi-frequency voltage 52 for a given time period that is adjacent in time to, overlaps or both, the time period of a first time-voltage region and during which available ions are redistributed according to the polarity of the created ions and the polarity of the polarizing field created by multi-frequency voltage 52. Also, while in the second time-voltage region, multi-frequency voltage 52 does not exceed the positive or negative corona onset threshold voltages. For example, in FIGS. 3A and 3C, when in any of second time-voltage regions 72-1 through 72-4, multi-frequency voltage 52 has a positive voltage exceeding positive polarization threshold voltage 68*a* but not exceeding positive corona onset voltage threshold 66*a* for ionizing cell 48. Thus, while in second time-voltage region 74-1 through 74-4, multi-frequency voltage 52 redistributes ions previously created and available within distances 62*a* and 62*b* by attracting negative ions 75*a* and 75*b* and repelling positive ions 77*a* and 77*b*. Second time-voltage regions in which a multi-frequency voltage 52 has a positive voltage, such as second time-voltage regions 72-1 through 72-4, may be hereinafter referred to as positive second time-voltage regions. Similarly, as seen in FIGS. 3B and 3C, when in any of second time-voltage regions 74 -1 through 74-4, multi-frequency voltage 52 has a negative voltage exceeding negative polarization threshold voltage 68*b* but not exceeding negative corona onset voltage threshold 66*b* for ionizing cell 48. Thus, while in second time-voltage region 74-1 through 74-4, multi-frequency voltage 52 redistributes ions previously created and available within distances 62*a* and 62*b* by creating a polarizing filed that repels negative ions 75*a* and 75*b* and attracts positive ions 81*a* and 81*b*. Second time-voltage regions in which a multi-frequency voltage 52 has a negative voltage, such as second time-voltage regions 74-1 through 74-4, may be hereinafter referred to as negative second time-voltage regions.

The third time-voltage region describes a waveform area representing the voltage amplitude of multi-frequency voltage 52 for a given time period that neither abuts in time nor overlaps the time period of a first time-voltage region and during which available ions are redistributed according to the polarity of the created ions and the polarity of the polarizing field created by multi-frequency voltage 52. For example in FIGS. 3A and 3C, when in any of third time-voltage regions 76-1 through 76-2, multi-frequency voltage 52 has a positive voltage exceeding positive polarization threshold voltage 68*a* but not exceeding positive corona onset voltage threshold 66*a* for ionizing cell 48. Thus, while in third time-voltage regions 76-1 or 76-2, multi-frequency voltage 52 redistributes ions available within distances 62*a* and 62*b* by creating a positive polarizing field that attracts a cloud of negative ions and repels a cloud of positive ions. In addition, since in this example, charged object 80 has negative charge 81*a*, the positive ions are also attracted to charged object 80 by negative charge 81*a*, further increasing the range and efficiency by which neutralizing ions can be dispersed toward charged object 80. Third time-voltage regions in which a multi-frequency voltage 52 has a positive voltage, such as third time-voltage regions 76-1 and 76-2, may be hereinafter referred to as positive third time-voltage regions.

In another example and with reference to FIGS. 3B and 3C, when in any of third time-voltage regions 78-1 and 78-2, multi-frequency voltage 52 has negative voltage exceeding negative polarization threshold voltage 68*b* but not exceeding negative corona onset voltage threshold 66*b* for ionizing cell 48. Thus, while in third time-voltage region 78-1 or 78-2, multi-frequency voltage 52 redistributes ions previously created and available within distances 62*a* and 62*b* by creating a negative polarizing field that repels negative ions 75*a* and 75*b* and attracts positive ions 77*a* and 77*b*. In addition, since charged object 80 has positive charge 81*b*, the negative ions are also attracted to charged object 80 by positive charge 81*b*, further increasing the range and efficiency by which neutralizing ions can be dispersed toward charged object 80. Third time-voltage regions in which a multi-frequency voltage 52 has a negative voltage, such as third time-voltage regions 78-1 and 78-2, may be hereinafter referred to as negative third time-voltage regions.

Multi-frequency voltage 52 may be created by summing or combining at least two alternating voltages with one of the alternating voltages having a relatively high frequency and the other having a relatively low frequency. For example, referring to FIG. 3C, multi-frequency voltage 52 is created from the sum of a first voltage component 82 and a second voltage component 84. First voltage component 82 has an alternating frequency in the range of approximately 1 kHz to 100 kHz, preferably between 2 kHz and 20 kHz, while second voltage component 84 has an alternating frequency in the range of approximately 0.1 Hz to 500 Hz, although preferably between 0.1 Hz and 100 Hz.

First voltage component 82 also includes relatively high amplitude voltages that, when combined with second voltage component 84, exceed during certain time periods the positive or negative corona onset threshold voltage required to generate ions by corona discharge in an ionizing cell. In the embodiment of the present invention shown in FIG. 3C, first voltage component 82 includes voltage amplitudes greater than the corona onset threshold voltage of ionizing cell 48, while second voltage component 84 includes voltage amplitudes greater than the polarization threshold voltage of the ionizing cell. However, one of ordinary skill in the art would readily recognize that the voltage amplitudes of first and of second voltage components 82 and 84 do not individually have to exceed the respective corona onset and polarization threshold voltages of ionizing cell 48 but when combined is sufficient to create a multi-frequency voltage that includes voltage amplitudes exceeding either the corona onset threshold voltage, polarization threshold voltage or both of an ionizing cell, such as ionizing cell 48.

The polarizing effectiveness of multi-frequency voltage 52 when used in an ionizing cell is dependent on many factors, including the shape and position of the ionizing electrode used and the position of the weighted center of the bipolar ion cloud within the distance between an ionizing electrode and a reference electrode, such as distance 62*a* or 62*b*. In the embodiment shown in FIGS. 3A through 3B, aligning the weighted center of the bipolar ion clouds created during corona discharge within the approximate middle of distances 62*a* and 62*b* maximizes the ion polarization of the bipolar ion clouds.

First voltage component 82 of multi-frequency voltage 52 causes ions comprising a bipolar ion cloud to oscillate between an ionizing electrode and a reference electrode, such as between ionizing electrode 50 and reference electrode 54*a* and between ionizing electrode 50 and reference electrode 54*b*. Further details may be found in U.S. Pat. No. 7,057,130 entitled "Ion Generation Method and Apparatus", hereinafter referred to as the "Patent".

Respectively positioning the weighted center of bipolar ion cloud within distance 62*a* or distance 62*b* may be accomplished by empirical means or by using the following equation, which is also taught in the Patent:

$$V(t)=\mu*F(t)/G2 \quad [1]$$

where V(t) is the voltage difference between ionizing electrode 50 and a reference electrode, such as reference electrode 54*a* or 54*b*, μ is the average mobility of positive and negative ions, F(t) is the frequency of multi-frequency voltage 52 and G is equal to the size of the distance, such as distance 62*a* or 62*b*, between ionizing electrode 50 and a reference electrode, such as reference electrode 54*a* or 54*b*, respectively.

Equation [1] characterizes, among other things, the relationship of the voltage and frequency of an ionizing voltage with the position of the weighted center of a bipolar ion cloud within the distance formed between an ionizing and a reference electrode, such as distance 62*a*, which is formed between ionizing electrode 50 and reference electrode 54*a* and distance 62*a*, which is formed between ionizing electrode 50 and reference electrode 54*b*.

Positioning the weighted center of a bipolar ion cloud approximately between an ionizing electrode and a reference electrode enhances the polarization effectiveness of a multi-frequency voltage, such as multi-frequency voltage 52. This positioning may be accomplished by adjusting the amplitude, frequency or both, of first voltage component 82. However, it has been found that the most convenient method of adjusting the position of a bipolar ion cloud is by adjusting the amplitude of first voltage component 82, while keeping the distance between the ionizing electrode and a reference electrode in the range of 5E-3m and 5E-2m and the frequency of first voltage component 82 in the range 1 kHz and 100 kHz, and assuming an average light ion mobility in the range of 1E-4 to 2E-4 [m2/V*s] at 1 atmospheric pressure and a temperature of 21 degrees Celsius.

Although equation [1] characterizes an ionizing cell having an ionizing electrode and a reference electrode that is relatively flat, one of ordinary skill in the art after reviewing this disclosure and the above referred United States patent application would recognize that the centered position of an oscillating bipolar ion cloud can be characterized using the above mentioned variables for other configurations and/or shapes of an ionizing electrode and reference electrode(s).

Second voltage component 84 may also include a DC offset (not shown) for balancing the number of positive and negative ions generated. A positive DC offset increases the number of positive ions generated, while a negative DC offset increases the number of negative ions generated. For example, adding a positive DC offset to second voltage component 84 causes second voltage component 84 to have an alternating asymmetrical waveform, which in turn will cause multi-frequency voltage 52 to remain generally at a longer period of time above corona onset and polarization threshold voltages 66*a* and 68*a*, respectively, and to remain for a shorter period of below corona onset and polarization threshold voltages 66*b* and 68*b*, respectively, than multi-frequency voltage 52 would have if second voltage component 84 did not have a DC offset. Alternatively, providing a negative DC offset to second voltage component 84 causes second voltage component 84 to have also an alternating asymmetrical waveform, which in turn will cause multi-frequency voltage 52 to remain generally at a shorter period of time above corona onset and polarization threshold voltages 66*a* and 68*b*, respectively, and to remain for a longer period of below corona onset and polarization threshold voltages 66*b* and 68*b*, respectively, than multi-frequency voltage 52 would have if second voltage component 84 did not have a DC offset. The combined peak voltage amplitude and maximum DC offset for second voltage component 84 may be less than the threshold voltage that will create a corona discharge for a particular ionizing cell, which in the embodiment disclosed herein, is typically within +/−10 to 4000V.

Figure 4:
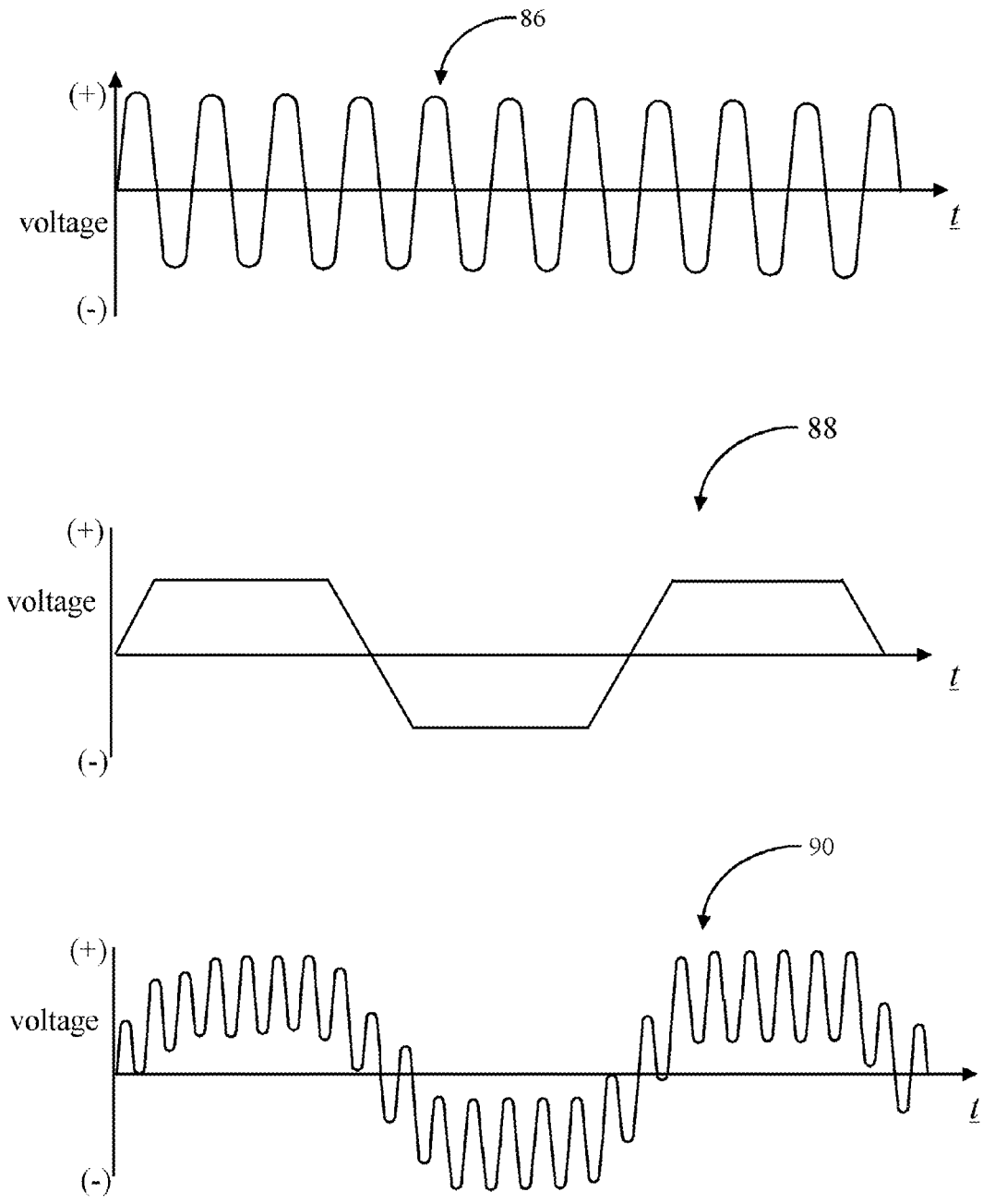
FIG. 4 illustrates a multi-frequency voltage formed by combining first and second component voltages in accordance with yet another embodiment of the present invention.

Still referring to the example shown in FIG. 3C, first voltage component 82 and second voltage component 84 that have sinusoidal waveforms that start at a phase value of 0 degrees. The use of sinusoidal waveforms or waveforms that are in phase with each other is not intended to be limiting in any way. Other starting phase values and types of waveforms, such as trapezoidal, non-sinusoidal, pulse, saw tooth, square wave, triangular and other types of waveforms, and may be used and in different combinations. For example, referring to FIG. 4, a first voltage component 86 having a sinusoidal waveform may be combined with a second voltage component 88 having a trapezoidal waveform to form a multi-frequency voltage 90.

Figure 5:
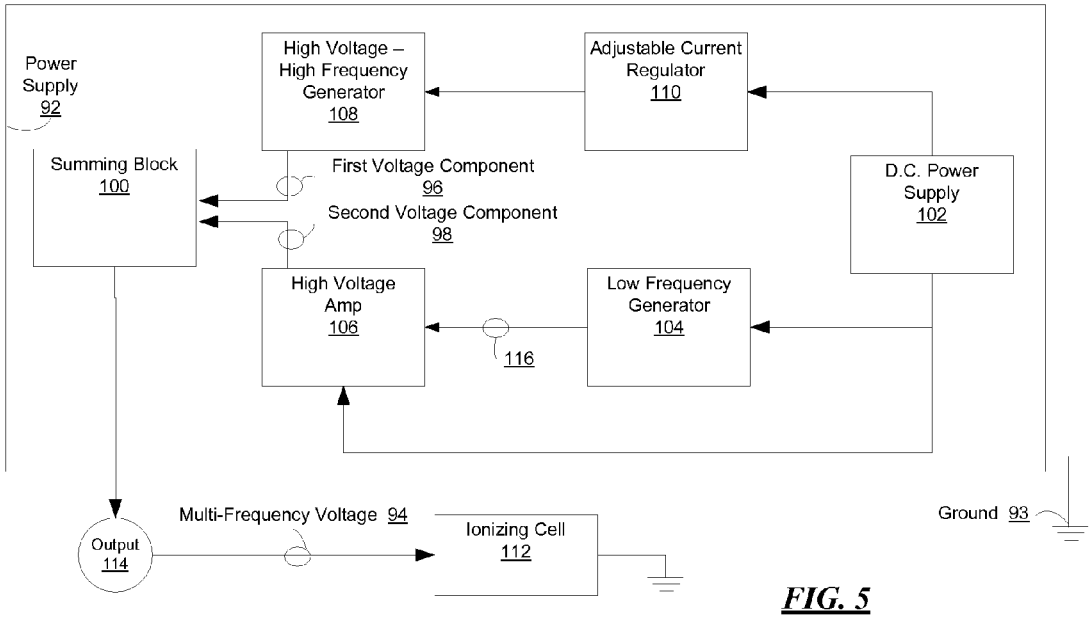
FIG. 5 is a block diagram of a power supply in accordance with another embodiment of the present invention.

Referring now to FIG. 5, power supply 92 may be used to generate a multi-frequency voltage 94 by combining a first voltage component 96 and a second voltage component 98 using a summing block 100. Power supply 92 includes a DC power supply 102 electrically coupled to a low frequency generator 104, a high voltage amplifier 106 and a high voltage-high frequency generator 108 via an adjustable current regulator 110. Power supply 92 may be used with an ionizing cell 112 having substantially the same elements and function as ionizing cell 6, 26 or 48. Power supply 92 also includes an output 114 coupled to at least one ionizing electrode (not shown) of ionizing cell 112, enabling power supply 92 to provide multi-frequency voltage 94 to the ionizing electrode during operation. Power supply 92 also provides a reference voltage 93, which in the embodiment shown in FIG. 65 is in the form of ground.

Low frequency generator 104 and high voltage amplifier 106 receive current and voltage from DC power supply 102. Low frequency generator 104 generates an alternating output signal 116 having a frequency in the range of 0.1 and 500 Hz, preferably between 0.1 and 100 Hz. High voltage amplifier 106 generates second voltage component 98 by receiving and amplifying alternating output signal 116 to a voltage amplitude of between 10 and 4000 volts. High voltage amplifier 106 may also provide an adjustable DC offset voltage in the range of +/−10 and 500 volts. It is contemplated that the maximum amplitude provided by high voltage amplifier 106 for second voltage component 98 is may be less than the corona onset threshold voltage for ionizing cell 112 and less than the maximum voltage amplitude selected for first voltage component 96.

High voltage-high frequency generator 108 generates first voltage component 96 and includes an adjustment for selecting the frequency of first voltage component 96. The voltage amplitude of high voltage-high frequency generator 106 is selectable by adjusting the amount of current provided by adjustable current regulator 110 to first voltage component 96. In accordance with one embodiment of the present invention, the position of the weighted center of an ion cloud generated using ionizing cell 112 and multi-frequency voltage 94 may be selected by adjusting the frequency output of high voltage-high frequency generator 108 and then fine tuning the position of the weighted center of the ion cloud by adjusting the voltage amplitude of first voltage component 96 by adjusting the amount of current provided by adjustable current regulator 110 to high frequency-high voltage generator 108.

Since summing block 100 combines first and second voltage components 96 and 98 to generate multi-frequency voltage 94, the form of multi-frequency voltage 94 is dependent substantially on the form of first voltage component 94 and second component voltage 96. For example, power supply 92 may be used to generate multi-frequency voltage 52, disclosed above with reference to FIG. 3C, if first and second voltage components 96 and 98 are in the form of first and second voltage components 82 and 84, respectively. Similarly, power supply 92 may be used to generate multi-frequency voltage 90, disclosed above with reference to FIG. 6, if first and second voltage components 96 and 98 are substantially in the form of first and second voltage components 86 and 88, respectively.

Figure 6:
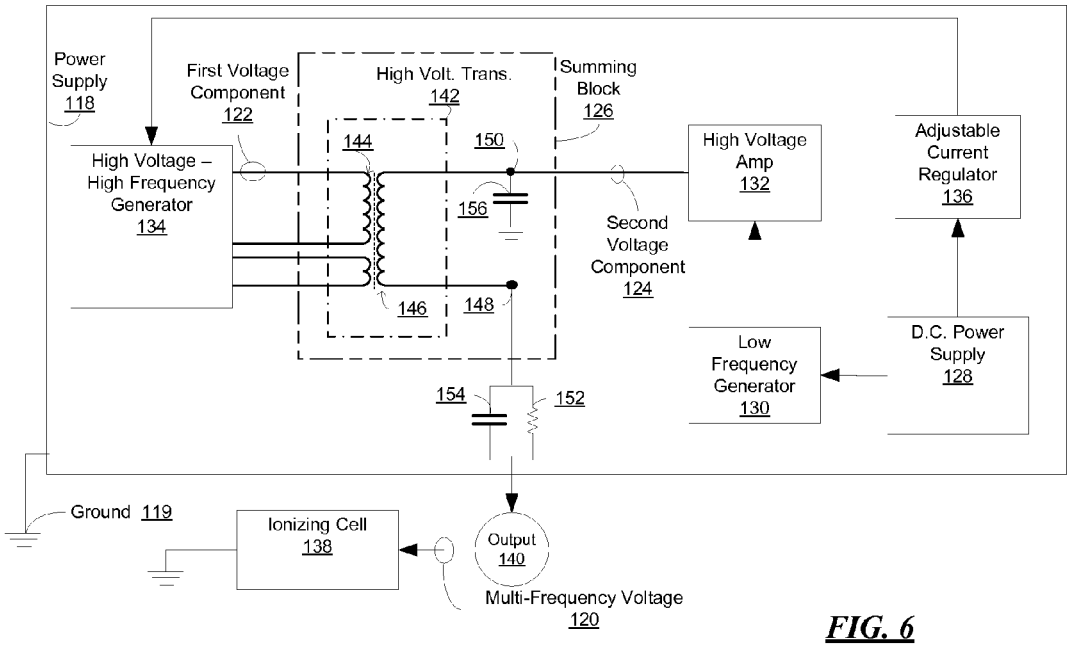
FIG. 6 is a block diagram of a power supply in accordance with another embodiment of the present invention.

FIG. 6 is a simplified block diagram of a power supply 118 in accordance with another embodiment of the present invention. Like power supply 92 in FIG. 5, power supply 118 provides a multi-frequency voltage 120 by combining a first voltage component 122 and a second voltage component 124 using a summing block 126. Power supply 118 includes a DC power supply 128 electrically coupled to a low frequency generator 130, a high voltage amplifier 132 and a high voltage-high frequency generator 134 via an adjustable current regulator 136. Power supply 118 may be used with an ionizing cell 138 having substantially the same elements and function as ionizing cell 6, 26 or 48. Power supply 118 also includes an output 140 coupled to at least one ionizing electrode (not shown) of ionizing cell 138, enabling power supply 118 to provide multi-frequency voltage 120 to the ionizing electrode during operation. Power supply 118 also provides a reference voltage 119, which in the embodiment shown in FIG. 6 is in the form of ground.

Summing block 126 is implemented using a high voltage transformer 142, low and high pass filters and virtual and physical grounds. In the example shown, the outputs of high voltage-high frequency generator 134 and high voltage amplifier 132 are electrically coupled to high voltage transformer 142, which has a primary coil 144 for receiving a high voltage-high frequency signal from high voltage-high frequency generator 134 and a secondary coil 146 having a first terminal 148 and a second terminal 150.

First terminal 148 couples low pass filter, which includes the inductance of secondary coil 146 and resistor 152, and high pass filter 154, 156 with ionizing cell 138. These filters prevent undesirable interaction of high frequency and low frequency parts of power supply 118 during static neutralization. The low pass filter 146,152 may be implemented by using a resistor having a value that provides a relatively low resistance to low frequency current and high resistance to high frequency current, such as a resistor having a value in the range of approximately 1 and 100 MΩ, preferably in the range of approximately 5 and 10 MΩ. High pass filter 154, 156 may be implemented by using a capacitor having a value that provides a relatively low resistance to high frequency current and relatively high resistance to low frequency current, such as a capacitors 154 and 156 having a value in the range of approximately 20 pF and 1000 pF, preferably in the range of approximately 200 pF and 500 pF. With respect to the embodiment shown in FIG. 6, the terms "low frequency" and "high frequency" are respectively currently contemplated to be in the approximate range of 0.1 Hz and 500 Hz, and in the range of 1 kHz and 100 kHz. In accordance with another embodiment of the present invention, the term "low frequency" is a frequency in the approximate range of 0.1 Hz and 100 Hz, which the term "high frequency" is a frequency in the approximate range of 1 kHz and 20 kHz.

Second terminal 150 is coupled to the output of high voltage amplifier 132 and to a "virtual ground" circuit 156, which is implemented in the form of a capacitor. Circuit 154 functions as an open circuit for low frequency high voltage generated by the combination of high voltage amplifier 132 and low frequency generator 130.circuit 156 also functions as a grounding circuit or "virtual ground" for any high voltage-high frequency voltage induced on secondary coil 146.

In an alternative embodiment, high voltage-high frequency generator 134 is implemented using a Royer-type high voltage frequency generator having a high frequency transformer that includes a primary coil and a secondary coil. This high frequency transformer may be used to implement high voltage transformer 142, reducing the cost of implementing power supply 134 and eliminating the need to provide an additional high voltage transformer 142.

In accordance with yet another embodiment of the present invention, an ion cloud created by a multi-frequency voltage is used to neutralize a moving charged object. Selected attributes of the moving charged object are used to adjust the waveform of the multi-frequency voltage, such as by adjusting at least one voltage component that is used in combination with another voltage component to create the multi-frequency voltage. The selected attribute(s) may include any attribute of the charged object targeted for static neutralization that would be relevant to the static neutralization efficiency, effectiveness or both of the ion cloud when the multi-frequency voltage is applied to at least one ionizing electrode from an ionizing cell or group of ionizing cells.

Figure 7:
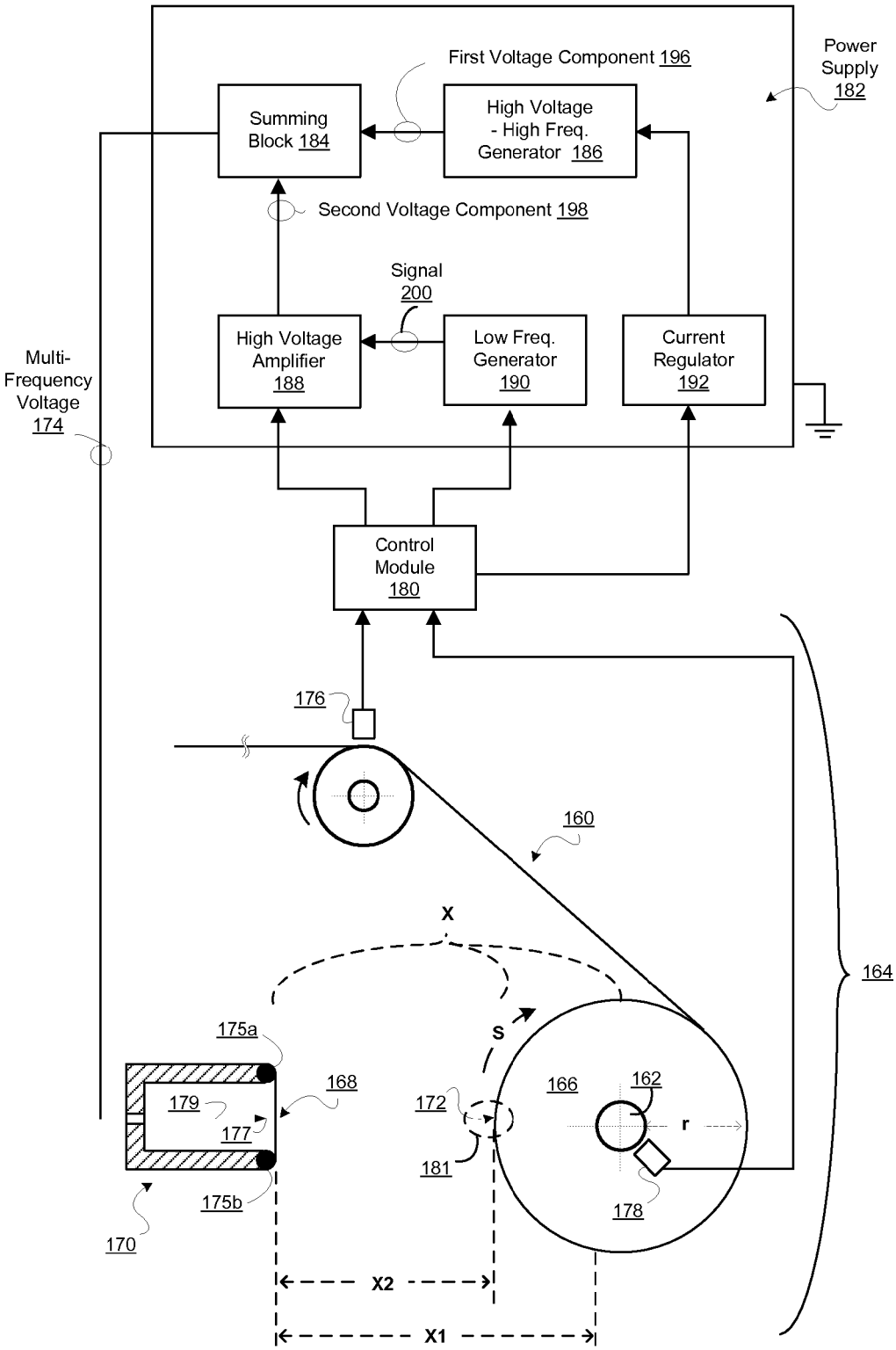
FIG. 7 is a block diagram of an ionizing cell coupled to a power supply generates a multi-frequency voltage based on at least one attribute of a moving electrically charged object in accordance with yet another embodiment of the present invention.

For example, referring now to FIG. 7, the moving charged object may be in the form of a web 160 that is wound onto a shaft 162 by a winding machine 164, creating a winding roll 166. The term "web" is commonly known and is used in the converting industry to refer to a relatively thin long and flat object, such as a sheet of material. When comprised of a material that has electrically insulating properties, the web becomes prone to retaining an electro-static charge, which sometimes requires static neutralization.

Charge neutralization on web 160, or its equivalent, creates certain challenges because at least one physical attribute related to web 160 changes as web 160 is wound onto shaft 162. For example, one attribute may include the distance X between a selected point 168 on an ionizing bar 170 and a portion 172 selected for neutralization on web 160, while another attribute may include the velocity S of portion 172 as it passes selected point 168. Ionizing bar 170 is shown in cross section and may include a plurality of ionizing electrodes, including ionizing electrode 179, and at least one reference electrode, such as reference electrodes 175*a*, 175*b* or both. The function of ionizing electrode 173 and reference electrodes 175*a* and 175 are similar to those disclosed with reference to ionizing cells above. However, the term "ionizing bar" is used to refer to an ionizing cell having a plurality of ionizing electrodes having electrode tips, including tip 177, that are pointed approximately perpendicular to the same reference plane, such as a plane formed tangentially to portion 172, and at least one reference electrode that permits the creation of an ion cloud upon application of multi-frequency voltage 174 to the ionizing electrodes. The use of ionizing bar 170 is not intended to limit the invention in any way. A single ionizing cell or a group of ionizing cells may be used.

The term "selected point" includes a point within a location on or near ionizing bar 170 from which ions may be generated when multi-frequency voltage 174 is provided to ionizing bar 170. For instance, selected point 168 may be on the surface of tip 177, on the surface of reference electrode 175*a* or 175*b* facing web 160, or on a plane connecting reference electrodes 175*a* and 175*b*. The term "portion" when used in reference to a web includes any portion of the web that passes a space, such as space 181, in which ions are created by ionizing bar 170 during operation of winding machine 164 and ionizing bar 170.

Distance X may have a value X1 approximately within a range of 0.5 to 1 m when winding roll 166 is first created. Distance X decreases as more of web 160 is wound onto shaft 162, resulting in distance X having a value of X2 that is approximately within a range of 0.02 to 0.05 m. In addition, the velocity S of web 160, relative to the position of ionizing bar 170, may also need to be taken into consideration to achieve sufficient charge-neutralization of each portion of web 160 that passes space 181.

A winding machine, such as winding machine 164, is known by those of ordinary skill in the art and can include devices, such as sensors 176 and 178, to monitor or measure certain parameters related to the shaft rotation of shaft 162 and the web length and web velocity S of portion 172 when web 160 is wound onto winding roll 166. In the embodiment shown, a control module 180 receives information representing these parameters from sensors 176 and 178.

Power supply 182 provides multi-frequency voltage 174 to ionizing bar 170 and includes a summing block 184, a high voltage-high frequency generator 186, a high voltage amplifier 188, a low frequency generator 190 and a current regulator 192, which may be implemented to have substantially the same form and function, respectively, as elements 100, 108, 106, 190 and 110, previously disclosed in FIG. 5. All voltages are referenced to a selected voltage, such as ground.

Summing block 184 is electrically coupled to at least one ionizing electrode from at least one ionizing bar, such as ionizing electrode 179 and ionizing bar 170, respectively. Summing block 184 is also electrically coupled to high voltage-high frequency generator 186 and high voltage amplifier 188. High voltage-high frequency generator 186 and high voltage amplifier 188 respectively generate a first voltage component 196 and a second voltage component 198, which are received and combined by summing block 184 as described herein. High voltage-high frequency generator 186 is electrically coupled to current regulator 192, which in turn is electrically coupled to control module 180. High voltage amplifier 188 is electrically coupled to low frequency generator 190. High voltage amplifier 188 amplifies an alternating output signal 200 that has a frequency generated by low frequency generator 190. Low frequency generator 190 and high voltage amplifier 188 are electrically coupled to control module 180.

Power supply 182 is integrated with a control module 180. Control module 180 is coupled to high voltage amplifier 188, low frequency generator 190, current regulator 192 and to various devices, such as sensors 176 and 178, for sensing selected attributes of web 160. Control module 180 receives information from these sensors and uses the information to adjust at least one voltage component that is used in combination with another voltage component to create multi-frequency voltage 174. Control module 180 uses the information received from sensors 176 and 178 to adjust the voltage, current or both, provided by control module 180 to high voltage amplifier 188, low frequency generator 190 and current regulator 192, setting the voltage and frequency of voltage components 178 and 180, respectively. This permits power supply 182 to generate multi-frequency voltage 174 that is based on at least one attribute related to web 160.

For example, in FIG. 7, control module 180 adjusts the amplitude of the voltage component, such as second voltage component 198, that provides the polarization effect for multi-frequency voltage 174, according to the distance, such as distance X, between selected point 168 and portion 172. Control module 180 obtains the current radius r of winding roll 166 and calculates the distance X between selected point 168 and portion 172 of winding roll 166 by using equation [2]:

$$X=x1-r \quad [2]$$

where x1 is a constant defined by the preinstalled distance between selected point 168 and surface of the shaft 162. The current radius r of the winding roll can be obtained by measuring length of the web L at certain number N rotations of the shaft, which can be expressed using the following equations: $L=2\pi rN$ and $r=L/(2\pi N)$. Sensors monitoring shaft rotation 178 and length of web 176 are part of microprocessor-based control system of the web machine. This permits current radius r to be obtained from such a web machine control system (not shown in FIG. 7).

Control module 180 adjusts the amplitude of second voltage component 198 by adjusting the output amplitude of high voltage amplifier 188 based on equation [3] below, which describes the relationship between the amplitude of second voltage component 198 and distance X:

$$U(t)=k1*X \quad [3]$$

where U(t) is the amplitude of second voltage component 198 and k1 is a constant coefficient defined by the characteristics of ionizing bar 170. These characteristics may include the shape and number of electrodes, whether ionizing or reference, employed and their orientation, as well as other physical characteristics of ionizing bar 170.

Under equation [3], when portion 172 is at the maximum distance from selected point 168, control module 180 adjusts the output of high voltage amplifier 188 to a maximum amplitude, which in turn causes second voltage component 198 to have a maximum amplitude. At maximum amplitude, second voltage component causes summing block 184 to output a multi-frequency voltage 174 that, when applied to ionizing electrode 179, creates a highly polarized ion cloud, causes a portion of the cloud to move quickly from ionizing bar 170 to portion 172 and provides a relatively high level of neutralization efficiency, which is the achievement of an intense ion cloud flow directed to the charged web surface, even when portion 172 is at a relatively large distance from selected 168, such as a distance of approximately between 0.5 to 1.0 meters.

As winding machine 164 continues to wind web 160 onto shaft 162, radius r increases, which causes portion 172 to move closer to selected point 168. In effect, distance X decreases as r increases and thus, control module 180 decreases the amplitude of second voltage component 198 according to Equation [3]. Although decreasing the amplitude of second voltage component 198 decreases the polarization effect provided by multi-frequency 176, the distance X2 between portion 172 and the ion cloud (not shown) created by ionizing bar 170 is sufficiently small so that the electrostatic field arising from the electrostatic charge held by web 160 is relatively sufficient to attract quickly the ions of opposite polarity from the ion cloud.

Adjusting the waveform of multi-frequency voltage using another attribute, whether in combination with distance X or in lieu of, may also be performed. For example, the waveform of multi-frequency voltage 174 may be adjusted to minimize or eliminate uneven charge neutralization of web 160, which sometimes results in strips of charged and discharged areas of web 160, which is hereinafter referred to as a zebra effect. To avoid or minimize this zebra effect on web 160, the frequency of the voltage component that provides the polarization effect of multi-frequency voltage 174, such as second voltage component 198, may be selected according to the ion cloud travel time, distance X between selected point 168 and the portion of web 160 currently in position for static neutralization, such as portion 172, and the web velocity S of portion 172. The relationship among the frequency of second voltage component 198 and web velocity S and distance X may be expressed by equation [4]:

$$F(t)=k2*(S/X) \quad [4]$$

where k2 is a coefficient defined by the design configuration and installation parameters of ionizing bar 170, F(t) is the frequency of second voltage component, S is the web velocity of portion 172, and X is the distance between selected point 168 and portion 172.

A relatively low web velocity S, provides a longer period of time for an ion cloud created by ionizing bar to travel to the portion of web 160 in position to be neutralized, such as portion 172, and consequently, the frequency of second voltage component 198 may be at the lower end of its range, such as a frequency approximately within a range of 0.1 and 10 Hz. As web velocity S increases, control module 180 will increase the frequency of second voltage component 198. And at relatively larger distances X1, control module 180 sets the frequency of second voltage component 198 at a relatively lower frequency to provide the ion cloud enough time to travel to the portion of web 160 in position for neutralization, while at relatively shorter distances X2, control module 180 sets the frequency of second voltage at a relatively higher frequency, such as a frequency approximately within a range of 10 and 100 Hz.

Figure 8:
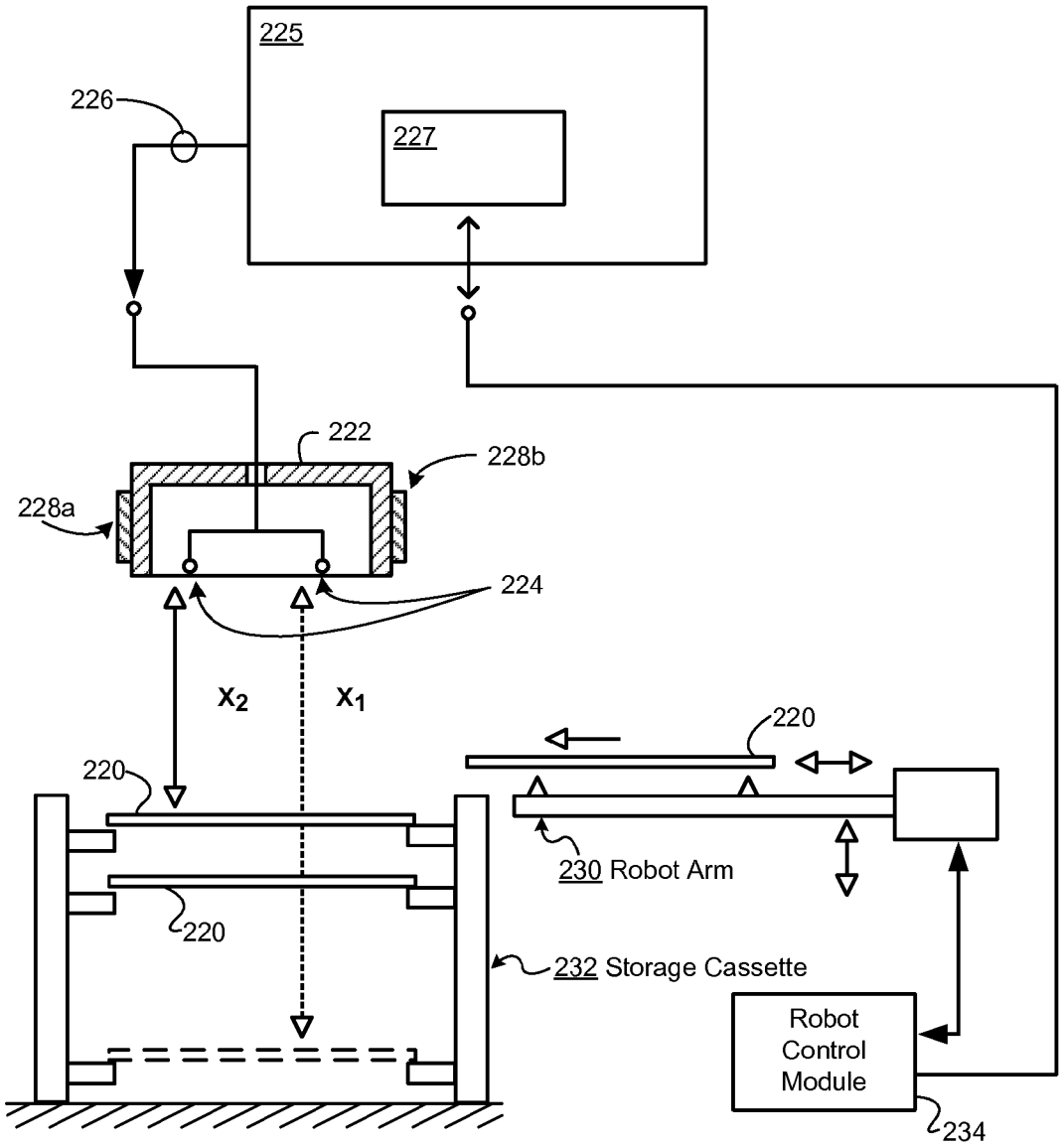
FIG. 8 is a block diagram of an ionizing bar, which is coupled to a multi-frequency power supply, for neutralizing a moving electrically charged object in accordance with yet another embodiment of the present invention.

FIG. 8 shows another preferred embodiment of multi-frequency static neutralization of a large charged object 220, such as a semiconductor substrate that has a dimension of up to 2×2 meters or more. Such semiconductor substrates may include for example, LCD substrates for manufacturing flat panel monitors and the like. These substrates are typically moved by an automated system, such as a robotic system, at an approximately constant and relatively slow velocity. However, the distances and changes in distance between an ionizing bar 222 and object 220 may be significant. In the embodiment shown in FIG. 8, such distances may range from as small as X2 and as large as X1, such as 0.1 and 3 meters respectively.

In the example shown, ionizing bar 222 may include one or a group of ion emitting filaments or wires, such as filaments 224 that are coupled to a power supply 225 that provides a multi frequency voltage 226 and that includes a control module 227. Power supply 225 and control module 227 may be implemented to have substantially the same function and structure of power supply 182 and control module 180, respectively, shown in FIG. 7 above.

Ionizing bar 222 may have one or a group of reference electrodes 228*a* and 228*b*. A robotic arm 230 moves object 220 from one processing chamber (not shown) to an intermediate storage or cassette 232. In FIG. 8, charged object 220 is waiting to be moved to a next processing chamber (not shown). Information about position and distance X between charged object 220 and ionizing bar 222 may be obtained from robot control module 234. Amplitude and frequency of one component (low frequency component) of multi frequency voltage 226 may be adjusted based on the distance, which can range from X1 to X2, between ionizing bar 222 and charged object 220. The voltage amplitude of one component U(t) of multi frequency voltage 226 may be defined from previously discussed Equation (3). Frequency F(t) of multi frequency voltage 2226 may be defined from Equation (5) below.

$$F(t)=k3/X \quad [5]$$

where k3 is a coefficient defined by the design and configuration of ionizing bar 222. At relatively large distances, such as X1, multi frequency voltage 226 according to Equation (3) provides a maximum voltage amplitude like 4,000 V. At this polarization voltage potential or greater, a polarizing field moves the ion cloud, which is created by multi-frequency voltage 226, with maximum speed. This mode means that ionizing bar 222 should also provide higher ionization current. The polarizing field and ion cloud are not shown in FIG. 8 to avoid overcomplicating this disclosure.

In addition, according to Equation (5), at relatively large distances, the frequency of the polarization voltage is reduced to a minimum frequency, such as 0.1-1.0 Hz. These frequencies provide a longer period of time for an ion cloud created by ionizing bar to travel to the charged object 220. As the distance between a charged object that is selected for charge neutralization is decreased, such as distance X2, the low frequency voltage amplitude may be also be decreased up to several hundred volts. At this point, ionizing bar 222 is producing lower ionization current and less erosion of the ion emitter(s) used. At the same time, frequency of the polarization voltage may be increased to within a range of 10 and 100 Hz. At these frequencies, charge neutralization avoids an uneven charge neutralization pattern, referred to above as the zebra effect, on charge objected 220.

While the present invention has been described in particular embodiments, it should be appreciated that the present invention should not be construed as limited by such embodiments. Rather, the present invention should be construed according to the claims below.

We claim:

1. An apparatus for neutralizing a moving electro-statically charged object, comprising:

a power supply having an output for providing a multi-frequency voltage having a waveform, said power supply disposed to generate said multi-frequency voltage by at least using a first component voltage having a first waveform and a second component voltage having a second waveform;

an ionizing cell having a first electrode and a second electrode, said first electrode for receiving said multi-frequency voltage, and said second electrode separated from said first electrode by a first distance and for use as a reference electrode; and wherein, said waveform is adjusted for neutralization of a moving object based on at least one attribute of said object, and said first waveform differs from said second waveform.

2. The apparatus of claim 1, wherein said first component voltage oscillates at a frequency of at least 2 kHz and said second component voltage oscillates at a frequency of no more than 500 Hz.

3. The apparatus of claim 1, wherein said object is a web wound onto a winding roll of a winding machine, said winding machine having at least one sensor; and wherein said power supply is integrated with a control module for receiving information from said sensors and for adjusting said multi-frequency voltage in response to said information.

4. The apparatus of 1, wherein said at least one attribute includes a velocity of said object.

5. The apparatus of 1, wherein said at least one attribute includes a distance from a portion of said object to said ionizing cell.

6. An apparatus for neutralizing a moving electro-statically charged object, said charged object having an object velocity, comprising:

a power supply having an output for providing a multi-frequency voltage, said power supply disposed to generate said multi-frequency voltage by at least using a first component voltage having a first waveform, and a second component voltage having a second waveform, said first waveform differs from said second waveform;

an ionizing cell having a first electrode and a second electrode, said first electrode for receiving said multi-frequency voltage, and said second electrode separated from said first electrode by a first distance and for use as a reference electrode;

wherein, in response to the application of said multi-frequency voltage to said first electrode, said multi-frequency voltage creates an oscillating ion cloud having positive ions and negative ions upon reaching a corona onset voltage threshold of said ionizing cell; and said multi-frequency voltage redistributes said positive and negative ions into separate regions when said multi-frequency voltage creates a polarizing electrical field; and wherein said polarizing electrical field has an electric field strength that varies relative to a second distance between said ionizing cell and the charged object.

7. The apparatus of 6, wherein said polarizing electrical field oscillates at a frequency relative to the object velocity and said second distance.

8. The apparatus of 6, wherein said polarizing electrical field oscillates at a frequency relative to the object velocity.

9. An apparatus for neutralizing a moving electro-statically charged object, said charged object having an object velocity, comprising:

a power supply having an output for providing a multi-frequency voltage, said power supply disposed to generate said multi-frequency voltage by at least using a first component voltage having a first waveform, and a second component voltage having a second waveform, said first waveform differs from said second waveform;

an ionizing cell having a first electrode and a second electrode, said first electrode for receiving said multi-frequency voltage, and said second electrode separated from said first electrode by a first distance and coupled to ground;

wherein, in response to the application of said multi-frequency voltage to said first electrode, said multi-frequency voltage creates an oscillating ion cloud having positive ions and negative ions upon reaching a corona onset voltage threshold of said ionizing cell; and said multi-frequency voltage redistributes said positive and negative ions into separate regions when said multi-frequency voltage creates a polarizing electrical field of sufficient strength; and wherein said polarizing electrical field oscillates at a frequency relative to the object velocity.

10. The apparatus of claim 9, wherein said strength varies relative to a second distance between said ionizing cell and the charged object.

11. The apparatus of 10, wherein said polarizing electrical field oscillates at a frequency relative to the object velocity and said second distance.

12. An apparatus for neutralizing a moving electro-statically charged object, said charged object having an object velocity, comprising:

an ionizing cell having a first electrode and a second electrode, said first electrode for receiving a multi-frequency voltage, and said second electrode separated from said first electrode by a first distance and coupled to a reference voltage;

a power supply having a summing block that creates said multi-frequency voltage by adding a first alternating voltage component and a second alternating voltage component, said first alternating voltage component having a first voltage amplitude and a first frequency, and said second alternating voltage component having a second voltage amplitude and a second frequency, wherein said first frequency differs from said second frequency; and wherein, in response to the application of said multi-frequency voltage to said first electrode, said multi-frequency voltage creates an oscillating ion cloud having positive ions and negative ions upon reaching a corona onset voltage threshold of said ionizing cell; and said multi-frequency voltage redistributes said positive and negative ions into separate regions when said multi-frequency voltage creates a polarizing electrical field.

13. The apparatus of claim 12, wherein said second voltage amplitude is relative to a second distance between said ionizing cell and the charged object.

14. The apparatus of claim 12, wherein said second voltage amplitude is selected according to the following equation:

$$U(t)=k1*X$$

where U(t) is said second voltage amplitude, k1 is a constant coefficient defined by a selected set of physical characteristics of said ionizing cell, and X is a second distance of the charged object from said ionizing cell.

15. The apparatus of claim 14, wherein said second distance is calculated from a surface of the charged object to an electrode surface of said ionizing cell.

16. The apparatus of claim 12, wherein said second frequency is relative to the object velocity.

17. The apparatus of claim 16, wherein said second frequency is further relative to a second distance, said second distance between said ionizing cell and the charged object.

18. The apparatus of claim 12, wherein said second voltage frequency is selected according to the following equation:

$$F(t)=k2*S/X$$

where F(t) is said second voltage frequency, k2 is a constant coefficient defined by a selected set of physical characteristics of said ionizing cell and a set of environmental characteristics in which said ionizing cell is used, S is the object velocity and X is a second distance of the charged object from said ionizing cell.

19. The apparatus of claim 18, wherein said set of environmental characteristics includes ion cloud travel time and further including a third electrode coupled to a reference voltage.

20. The apparatus of claim 12, wherein said reference voltage is equal to ground.

* * * * *